US005254222A

United States Patent [19]

Mazzini et al.

[11] Patent Number: 5,254,222

[45] Date of Patent: Oct. 19, 1993

[54] SEALING DEVICE

[75] Inventors: Lucien Mazzini, Hayange; Jean-Marc Leroy, Dunkerque, both of France

[73] Assignees: Sollac, Puteaux; Lorfonte, Uckange, both of France

[21] Appl. No.: 931,985

[22] Filed: Aug. 19, 1992

[30] Foreign Application Priority Data

Aug. 21, 1991 [FR] France ..... 91 10497

[51] Int. Cl.[5] ..... C10B 25/16

[52] U.S. Cl. ..... 202/248; 202/269

[58] Field of Search ..... 202/269, 248, 242; 110/173 R; 49/475, 477

[56] References Cited

U.S. PATENT DOCUMENTS 4,016,045 4/1977 Van Ackeren ..... 202/248

4,172,769 10/1979 Becker ..... 202/248

FOREIGN PATENT DOCUMENTS 1156762 11/1963 Fed. Rep. of Germany .

2495631 6/1982 France ..... 202/269

*Primary Examiner*—Joye L. Woodard

*Attorney, Agent, or Firm*—Oblon, Spivak, McClelland, Maier & Neustadt

[57] ABSTRACT

The device includes a sealing element fixed to the door of a coke oven, the sealing element having an edge forming a junction with the frame of the door, and a channel disposed on the periphery of the sealing element. A sealing gas at a pressure higher than the pressure of the gaseous medium inside the oven flows into the channel. The open side of the channel faces the door frame so as to form a buffer zone of sealing gas sealing off leaks created when the sealing element expands. The channel further includes a plurality of compartments provided with distinct means for supplying the compartments with sealing gas, whereby it is possible to adjust the pressure of the sealing gas in accordance with the places where the leakages are largest.

4 Claims, 2 Drawing Sheets

SEALING DEVICE

BACKGROUND OF THE INVENTION

1. Field of the Invention

The present invention relates to a sealing device between a door of a coke oven and a door frame. More precisely, the device according to the invention permits maintaining a good seal despite the deformations the door undergoes owing to temperature variations and despite deposits of tar issuing from the carbonization of the coal.

2. Discussion of the Background

The problem encountered in coke oven doors is the sealing against the dust from the oven and against the gases between the doors of the oven and the lateral walls of the oven or the door frame fixed to the walls of the oven.

It is very important, for ensuring a good coking and avoiding emissions to the atmosphere, to provide a perfect seal between the doors of the oven and the lateral walls or the walls of the frame of the door.

Indeed, in the event of the non-sealed closure of the oven during the coking process, crude gases charged with tar escape and entrain therewith a certain amount of tar. As soon as they reach the exterior of the oven, these gases cool and condense and the tar is deposited outside the doors and causes soiling.

When the leak is greater and the flow of escaping gas becomes considerable, this escaping gas is liable to self-ignite and in this way create, owing to the pressure, a veritable torch in the region of the leak resulting in an intense heating of the door frame and of the components for shifting the door and a deformation or even a deterioration of these components.

Bearing in mind the temperature which may prevail inside the coke oven, there are produced in the course of the coking process temperatures of the door and of the door frame which may vary between 80 and 200° C.

This variation in temperature results in a large expansion of the door and of the door frame, the deformations possibly reaching 50 mm.

It is known to employ sealing devices which comprise a sealing element forming a strip fixed to the door and having an edge forming a junction with the door frame, and a sealing element at the end of this strip providing a seal between the strip and the adjacent edges of the door frame.

Bearing in mind the large deformations the strip and the door frame undergo during the coking process, it is known to mount the sealing element on a device having a spring whereby it is possible to maintain the sealing element applied against the wall of the door frame, even when the strip of the door is no longer in contact with said wall. Such a device, described in the French Patent No. 2,362,911, requires complicated and costly elastic means which are hardly suitable for the environment of coke oven doors.

SUMMARY OF THE INVENTION

An object of the present invention is to provide a sealing device for a coke oven door whereby it is possible to maintain the seal despite the deformations of the door due to the temperature, without employing elastic means including a spring or other means.

The invention therefore provides a sealing device between a door of a coke oven and a door frame, comprising a sealing element fixed to the door and having an edge forming a junction with the frame, a channel connected to the door adjacent to the sealing element and supplied with sealing gas having a pressure higher than the pressure prevailing inside the oven, characterized in that the channel extends throughout the periphery of the door and includes a plurality of compartments respectively supplied with sealing gas through distinct supply conduits, each supply conduit including means for adjusting the sealing gas flow.

According to another feature of the invention, the sealing element is defined by strips, a first end edge of the sealing element constituting the edge providing the junction with the door frame and the second end edge of the sealing element including notches.

The invention also provides a coke oven comprising at least one door frame delimiting an opening and at least one door mounted so as to be movable relative to the frame in a direction substantially parallel to the axis of the opening, characterized in that the frame and the door comprise a sealing device as defined hereinafter.

An embodiment of the invention will now be described with reference to the accompanying drawings in which:

DESCRIPTION OF THE PREFERRED EMBODIMENT

Figure 1:
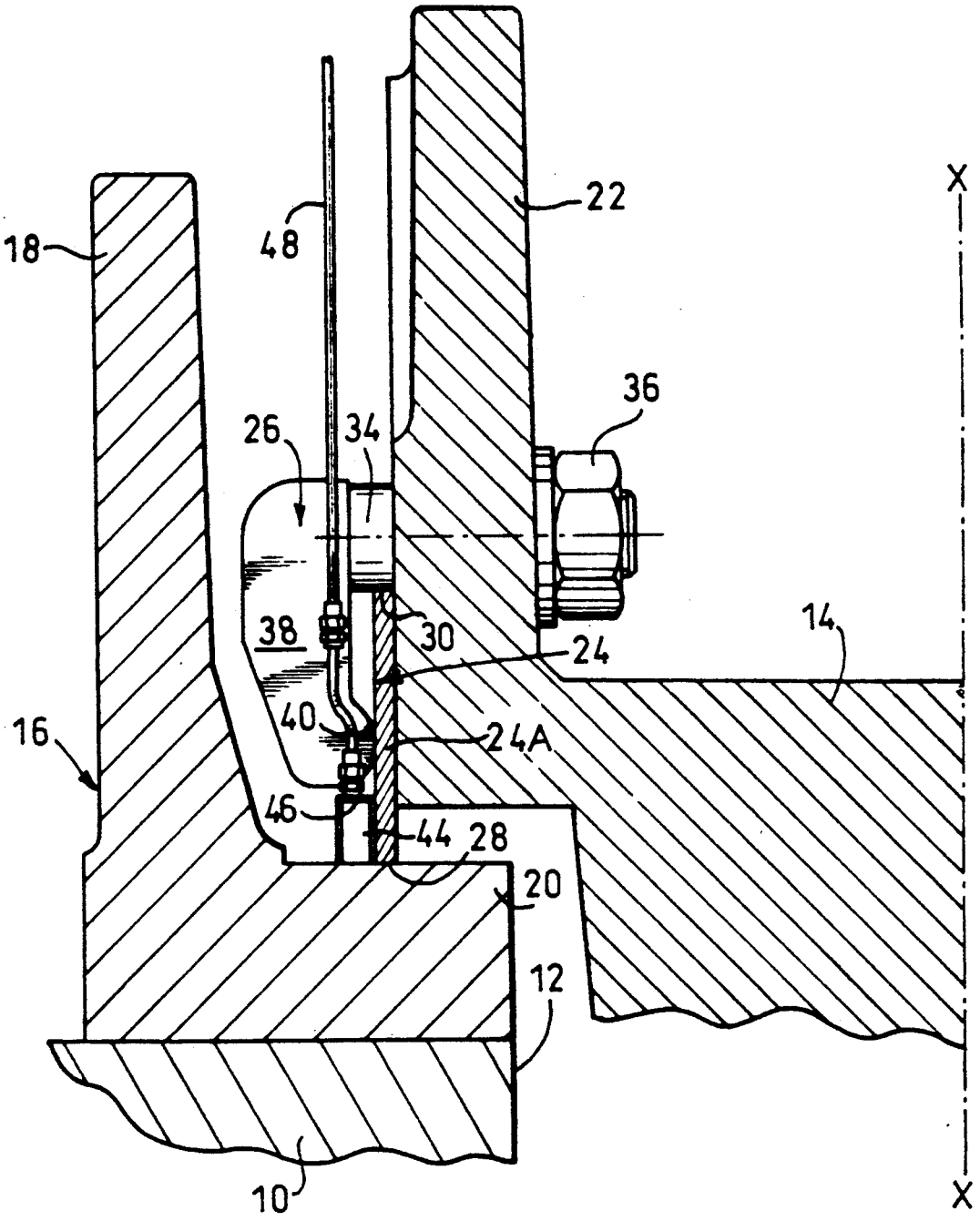
FIG. 1 shows a coke oven with an opening used for emptying the oven at the end of the coking process, wherein an axis X—X perpendicular to a side of the oven is shown where the opening is defined.

FIG. 1 shows a coke oven 10 with an opening 12 having an axis X—X, required for emptying the oven at the end of the coking process.

A door 14 enables the opening 12 to be closed in a sealed manner during the coking process. The opening-closing movement of the door 14 occurs along the axis X—X. The door 14 is connected to a shifting and guiding device (not shown) carried by the door frame 16. This door frame, which is fixed on an outer side of the coke oven 10 around the opening 12, comprises a wall 18 substantially parallel to an axis X—X perpendicular to a side of the oven where the opening 12 is defined and a wall 20 perpendicular to the wall 18 for fixing the frame 16 on the oven.

The door 14 is provided with a wall 22 which is substantially parallel to the axis X—X, projects toward the exterior of the oven, is located on the periphery of the door and is in one piece with the latter.

The opening 12 of the oven 10, the door 14, and the frame 16 have a generally rectangular shape, their width being small with respect to their height. For example the door 14 has a width of 30 cm and a height of 15 m.

Figure 2:
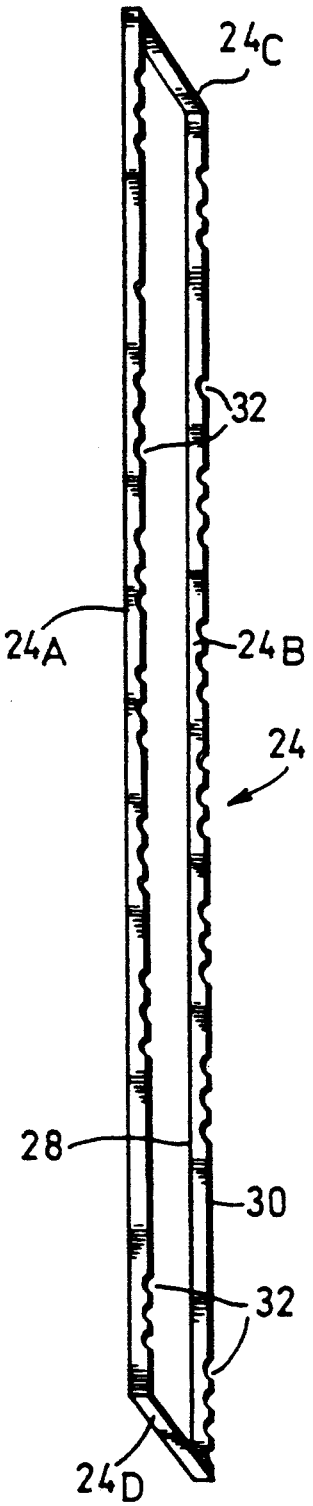
FIG. 2 is a perspective view of the sealing element.

Also shown in FIG. 1 is a sealing element adjacent to the peripheral wall 22 of the door 14. This sealing element 24 is shown in greater detail in FIG. 2. The sealing element comprises a rectangular frame 24 comprising four strips or blades 24A, 24B, 24C, 24D fixed to the door by clamping means 26 only one of which is shown in FIG. 1.

A first end edge 28 of the sealing element 24 constitutes an edge forming a junction with the wall 20 of the door frame 16 in the closed position of the door 14. The second end edge 30 of the sealing element 24 includes notches 32 provided on the strips 24A, 24B which extend along the height of the sealing element 24. These notches 32 reduce the deformations of the sealing element 24 due to temperature variations during operation of the oven. The notches 32 are spaced apart on the sealing element 24 at places undergoing a large expansion.

Each clamping means 26 comprises a body 34 extending through the peripheral wall 22 of the door in a direction perpendicular to the latter. A first screw-threaded end portion of the body 34, on the right as viewed in FIG. 1, carries a clamping nut 36. A second end portion of the body 34, on the left as viewed in FIG. 1, comprises an arm 38 extending in a direction roughly parallel to the peripheral wall 22 of the door 14. The sealing element 24 is clamped between the peripheral wall 22 of the door 14 and a projection 40 on the free end portion of the arm 38 of the clamping means 26.

The sealing element 24 carries a U-shaped channel 44 which is connected to the door 14 in that it is fixed by known means (not shown) to the sealing element 24. The open side of the channel 44 is adjacent to the junction edge 28 of the sealing element and is in facing relation to the wall 20 of the door frame 16 when the door 14 is in the closed position The inner end 46 of the channel 44 is connected to a conduit 48 supplying sealing gas under pressure.

Figure 3:
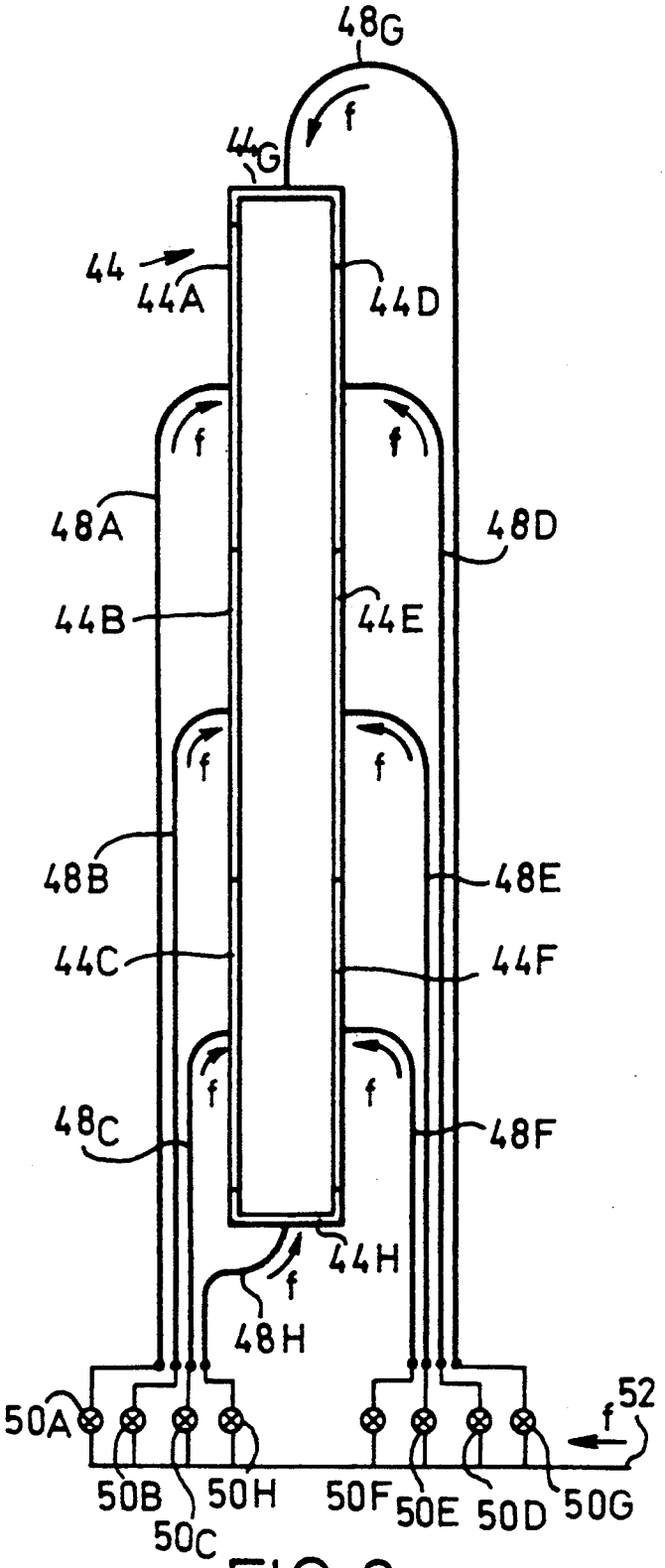
FIG. 3 is a diagrammatic elevational view of the channel in which the sealing gas flows and which surrounds the sealing element.

The whole of the channel 44 is shown diagrammatically in FIG. 3. This channel extends along the periphery of the sealing element 24 and has a generally rectangular shape similar to the shape of the sealing element 24. As seen in FIG. 3, the channel 44 has eight compartments 44A to 44H respectively supplied with sealing gas through eight distinct conduits 48A to 48H.

The two parallel parts of the channel 44 which extend along the height of the oven door each comprise three compartments. The two parallel parts of the channel 44 which extend along the width of the oven door each comprise a single compartment.

The conduits 48A to 48H are respectively connected to distinct means for adjusting the gas flow comprising valves 50A to 50H. These valves are connected to a general supply conduit 52. The directions of flow of the gas in the conduits shown in FIG. 3 are indicated by arrows f.

The gaseous medium contained in the oven 10 is at a pressure higher than the atmospheric pressure outside the oven. In the course of the coking process and in a particular a few minutes after the charging of the coke, the pressure difference of the gaseous medium contained in the oven and the atmosphere may reach and even exceed 16 millibars (1600 Pa). The sealing gas under pressure flowing in the compartments of the channel 44 is a neutral gas with respect to the gaseous medium contained in the oven 10. In the presently-described embodiment, the sealing gas is nitrogen. In the course of the coking, the pressure of the nitrogen in the compartments of the channel 44 is higher than the pressure of the gaseous medium in the oven, for example about 20 millibars (2000 Pa) above the atmospheric pressure.

In this way the channel 44 defines a buffer zone in which the nitrogen flows at a pressure higher than that of the gaseous medium contained in the oven 10. As the buffer zone is adjacent to the edge forming a junction between the sealing element 24 and the door frame 16, the gas of the coke oven does not escape to the exterior of the oven despite the appearance of sealing defects when the sealing element 24 is deformed under the effect of the temperature variations.

As the sealing defects between the door 14 and the door frame 16 are greater in the top part and bottom part of the door, it is possible to adapt the pressure of the nitrogen in the corresponding compartments of the channel 44. The distinct supply conduits 48A to 48H for the compartments 44A to 44H and the adjusting valves 50A to 50H disposed in these conduits permit adapting the pressure in each compartment of the channel 44 in accordance with the extent of the sealing defects. Thus, the operator has a control over the sealing of the door oven throughout its height by adjusting the different pressures in the compartments of the channel 44, these pressures being higher than the atmospheric pressure by about 15 to 30 millibars (1500 to 3000 Pa).

The notches 32 provided in the sealing element 24 permit optimizing the consumption of nitrogen by reducing the deformations of the sealing element 24 so as to minimize the leaks between the door 14 and the door frame 16.

The invention avoids the emission into the atmosphere of fumes or smoke coming from the coke oven by employing a sealing gas, flowing in a buffer zone, which does not cause the ignition of the escaping gases of the oven and consequently avoids deterioration of the entrances of the oven which are in particular composed of silica.

The channel in which the sealing gas flows may have various shapes. It may be in particular formed by an L-section element disposed on the periphery of the sealing element so as to be delimited by the walls of this L-section element and the strips of the sealing element.

Further, the invention avoids the entry of air which adversely affect the operating life of the openings of the oven. The invention protects the metal structure making up the coke oven by avoiding the ignition of the gases contained in the latter.

The invention also protects the environment by effectively controlling sealing of the coke oven doors and by avoiding emissions of polluting gas. The invention reinforces the safety conditions at the work place by preventing the escape of hot and harmful gases. The invention also results in an improved cleanliness of the workplace.

Obviously, numerous modifications and variations of the present invention are possible in light of the above teachings. It is therefore to be understood that within the scope of the appended claims, the invention may be practiced otherwise than as specifically described herein.

What is claimed is:

1. Sealing device for a coke oven, said device comprising:

a door frame having an opening;

a door mounted so as to be movable relative to said door frame in a direction substantially parallel to an axis perpendicular to a side of the oven where the opening is located.

a sealing element fixed to said door and having an edge for forming a junction with said door frame, a channel member connected to said door adjacent to said sealing element and extending throughout the periphery of said door and including a plurality of compartments, a plurality of distinct supply conduits respectively connected to said compartments for supplying sealing gas to said compartments, said sealing gas having a pressure higher than the pressure prevailing inside said oven, and means for adjusting the flow of said sealing gas in each supply conduit.

2. Sealing device according to claim 1, wherein said sealing element comprises a rectangular frame defined by four strips, a first end edge of said frame constituting an edge for forming a junction with said door frame, and a second end edge of said frame having notches formed therein.

3. Coke oven comprising:

a sealing device which includes a door frame defining an opening; a door mounted so as to be substantially parallel to an axis perpendicular to a side of the oven where the opening is defined, a sealing element fixed to said door and having an edge forming a junction with said frame, a channel member connected to said door adjacent to said sealing element and extending throughout the periphery of said door and including a plurality of compartments, a plurality of distinct supply conduits respectively connected to said compartments for supplying sealing gas to said compartments, said sealing gas having a pressure higher than the pressure prevailing inside said oven, and means for adjusting the flow of said sealing gas in each supply conduit.

4. Sealing device according to claim 3, wherein said sealing element comprises a rectangular frame defined by four blades, a first end edge of said frame constituting an edge for forming a junction with said door frame, and a second end of said frame having notches formed therein.

* * * * *